US006101934A

United States Patent [19]

Makin

[11] Patent Number: 6,101,934

[45] Date of Patent: Aug. 15, 2000

[54] PROCESS FOR DIRECT MULTICOLOR PRINTING ON BASKETBALL BACKBOARDS

[75] Inventor: David Makin, Washington Terrace, Utah

[73] Assignee: Lifetime Products, Inc., Clearfield, Utah

[21] Appl. No.: 09/228,210

[22] Filed: Jan. 11, 1999

Related U.S. Application Data

[60] Provisional application No. 60/093,291, Jul. 17, 1998.

[51] Int. Cl.[7] ..... B41F 17/00

[52] U.S. Cl. ..... 101/35

[58] Field of Search ..... 101/35

[56] References Cited

U.S. PATENT DOCUMENTS

| | | | |
|---|---|---|---|
| Re. 30,274 | 5/1980 | Bolon et al. | 361/411 |
| 5,335,594 | 8/1994 | Karlyn et al. | 101/35 |
| 5,626,339 | 5/1997 | Schickert | 473/481 |
| 5,909,021 | 6/1999 | Duffy | 200/514 |

OTHER PUBLICATIONS

Huffy Sports, "Performance Series," Product Information Brochure, 5 pages.

*Primary Examiner*—John S. Hilten
*Assistant Examiner*—Amanda B. Sandusky
*Attorney, Agent, or Firm*—Madson & Metcalf

[57] ABSTRACT

Multicolor graphic image screen printing on basketball backboards using ultraviolet light-cured inks is disclosed. The UV inks include a cure catalyst which enables the UV inks to meet adhesion and weatherability standards for basketball backboards. The UV inks are printed using fine mesh screens which provide high resolution and require less ink to print the graphic image. Four-color process printing, including photographic printing, is possible according to the present invention.

21 Claims, 1 Drawing Sheet

PROCESS FOR DIRECT MULTICOLOR PRINTING ON BASKETBALL BACKBOARDS

RELATED PATENT APPLICATION

This invention claims priority to U.S. Provisional Patent Application Ser. No. 60/093,291, filed Jul. 17, 1998, entitled "Process for Direct Multicolor Printing on Basketball Backboards," which application is incorporated herein by reference.

FIELD OF THE INVENTION

The present invention relates to a process for direct multicolor printing on plastic surfaces. The present invention is particularly useful in screen printing multicolor images, including photographs, directly on basketball backboards and similar surfaces.

BACKGROUND

Images and graphics have been directly screen printed onto plastic surfaces, such as basketball backboards. Some plastic surfaces accept printing ink more readily than others. For example, it is easier to print on polystyrene than on polyolefin surfaces.

In a typical screen printing process on polyolefin surfaces, such as a molded basketball backboard, the product is placed onto a conveyor. Dust and debris are removed from the surface using an air knife. The surface is then flame treated to increase the surface energy of the backboard substrate which will allow the ink to adhere to its surface.

A printer manually loads the product into a nested fixture. The surface is screen printed, and the conveyor moves the product into an oven at about 200° F. (93° C.) for about 35 seconds to heat cure the ink. The printer then repeats the foregoing process steps to add further color images. Finally, the product is removed from the conveyor and allowed to air dry.

In the current screen printing process on plastic surfaces, a 230 mesh screen is used, resulting in a dpi (dots per inch) resolution of between 12 and 15. It has been found that the typical solvent-based printing inks dry out quickly on full flood prints, usually after 10 to 20 passes. When the ink drys on the printing screen, inconsistent printing of poor quality results.

Regrettably, the oven heat used to heat cure the ink alters the size of a typical basketball backboard by as much as ¼ inch. This ¼ inch size change makes it very difficult or impossible to properly align additional printing screens for multicolor printing. Thus, the resolution on plastic surfaces, such as basketball backboards, using conventional screen printing processes is inadequate.

It would be an advancement in the art to provide a system for direct, multi-color printing on basketball backboards and other plastic surfaces which eliminate the problems relating to flame treating the printing surface and heat-cured inks described above.

SUMMARY OF THE INVENTION

The present invention represents a substantial improvement over the current screen printing process described above. According to the present invention, light-cured inks are used instead of heat-cured inks. For instance, the use of ultraviolet light-cured inks eliminates the need for curing ovens and the problems associated therewith.

Advantageously, the ultraviolet light-cured inks used in the present invention permit a finer mesh screen to be used, such as a 355 mesh screen. This enables much finer resolution, such as 35 to 45 dpi. It has been found that the higher resolution printing requires less ink, and it has also been found that the ultraviolet light-cured ink does not dry out on the screen at the higher resolution. Thus, the printing screens do not need to be cleaned as frequently, providing more consistent, higher quality printing. From 500 and 600 passes can be made between screen cleaning. Importantly, since heat is not used to cure the ink, registration from one screen to another is kept less than 1/16 inch. This enables multicolor, photographic quality images to be printed on plastic surfaces, such as molded basketball backboards.

The present invention is readily adapted to automation. For instance, the product surface is preferably locked into position on an automated conveyor. Computer controlled equipment aligns the product surface with a printing screen and applies ink to the product surface. The product is then transported to an ultraviolet cure region according to computer control. The steps are repeated as necessary to apply multiple colors to the product surface. Full four-color process printing is possible according to the present invention.

For black or very dark surfaces, a white image is preferably applied first to the surface, with the multiple colors being applied to the white image. The white image preferably represents the reverse black image of the conventional four-color image. The white base enables the colors to appear brighter. The black portion of the four-color image, is the black plastic surface.

For clear surfaces, such as acrylic basketball backboards, multicolor images are preferably applied to the reverse side of the backboard. An added benefit of ultraviolet light-cured inks is their glossy appearance, which is generally preferred over the flat heat-cured inks.

DETAILED DESCRIPTION OF THE INVENTION

Figure 1:
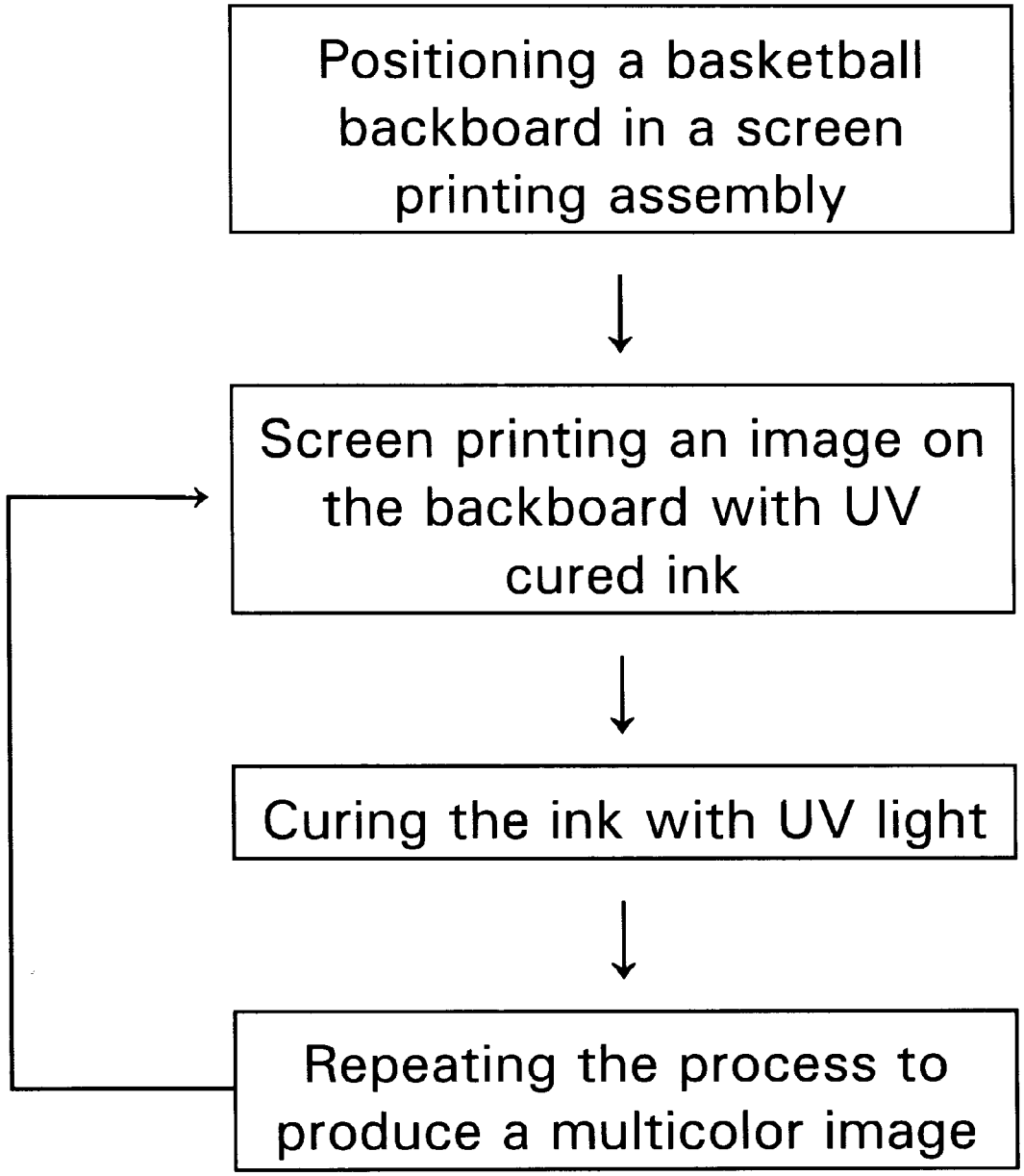
FIG. 1 is as schematic representation of process steps within the scope of the present invention.

The present invention is directed to a process for multicolor printing on basketball backboards. The present invention can be used with backboards of various composition, including, but not limited to, blow molded polyolefin, graphite composite, and acrylic backboards. According to the present invention, light-cured inks, such as ultraviolet light-cured inks (hereinafter referred to as UV inks), are used instead of conventional heat-cured inks. An added benefit of UV inks is their glossy appearance, which is generally preferred over the flat, heat-cured inks.

UV inks have been known for many years, but they have not, until the present invention, been successfully used in printing on basketball backboards. For some time now, manufacturers of basketball backboards have been investigating the possibility of using UV inks. However, UV inks have not been successfully used because they did not provide the needed adhesion to the backboard and weatherability. Although there are a large number of UV ink suppliers, the UV inks manufactured by Nazdar (located at Shawnee, Kans.) provide excellent results, with the 3200 product number UV inks being currently preferred.

As used herein, the UV ink adhesion is a measure of how firmly the ink adheres to the backboard surface. Adhesion is measured using a conventional scratch test. A currently preferred test is the standard ASTM D3359 (DIN standard 53151) cross-hatch paint adhesion test, which is incorporated herein by reference. In this test, a printed surface is scratched according the standard protocol and tape is applied to the surface and removed. If any of ink is removed by the tape, the ink failed the test. For manufacturing convenience, the UV ink adhesion should be good on all types of basketball backboards, such as blow molded polyolefin, acrylic, and graphite composite backboards.

As used herein, the UV ink weatherability is measured in an accelerated weathering device (referred to as a "QUV tester") which simulates outdoor weather conditions including sunlight, darkness, humidity, dryness, heat and cold cycles. Such devices are commercially available from Q-Panel Co., Cleveland, Ohio and Atlas Electric Devices Co., Chicago, Ill. The QUV tester is preferably operated according to the standard ASTM G 53-88 protocol, which is incorporated herein by reference. The UV inks must withstand the simulated weather conditions without undue fading or degradation. It is currently preferred to test the printed backboards for approximately 1000 hours.

To enable prior UV inks to pass the adhesion and weatherability tests it was necessary to apply a clear protective coating on the printed ink. It has been found that the addition of a cure catalyst in the UV inks enables the graphic images to be printed on basketball backboards which pass the adhesion and weatherability tests without the need for clear coatings. A currently preferred cure catalyst is provided by Nazdar (Shawnee, Kans.) under the tradename "NB80".

If too much catalyst is included in the UV ink, the cured ink is brittle and fails the abrasion/scratch test. If too little catalyst is used, then the cured ink fades fast and fails the weatherability test. For printing on typical backboard surfaces, the catalyst is preferably included in the UV ink from 5% to 10%, by weight.

One important advantage of using UV inks is the ability to screen print with fine mesh screens having a mesh size in the range from about 355 to 405. It is currently preferred to use a 355 mesh screen. Although higher mesh screens, such as 390 and 405 mesh can be successfully used in the present invention, these higher mesh sizes tend to be more expensive than the 355 mesh screen. Plain and twill weave screens, for example, can be used in the present invention. The fine mesh screens used herein enable the printing of high resolution graphics, including photo-quality graphics and four-color process printing, which has not been possible using 230 mesh screens and conventional inks.

Another important advantage of using fine mesh screens is that less ink is used, compared to conventional screen printing on a 230 mesh screen. It has been found that the UV inks should not be used with larger mesh screens, such as the 230 mesh screens, because too much ink is applied to the backboard surface. If too much UV ink is present, it does not cure completely and lacks good adhesion.

Additionally, because the UV inks cure only when exposed to UV light, they do not dry on printing screens. Therefore, the screens do not need to be cleaned as frequently as compared to current screens printing with heat-cured inks. This represents a substantial savings in product throughput and maintenance.

As previously mentioned, the present invention is readily adapted to automation and computer control. Open representation of a basketball backboard printing process within the scope of the present invention is illustrated in FIG. 1. For instance, the product surface is preferably locked into position on an automated conveyor. Computer controlled equipment aligns the product surface with a printing screen. Automated screen printing equipment applies ink to the product surface. The product is then transported to an ultraviolet cure region according to computer control. The steps are repeated as necessary to apply additional colors to the product surface.

To improve color printing on black or very dark surfaces, a white image is preferably applied first to the surface, with the multiple colors being applied to the white image. The white image preferably represents the reverse black image of the conventional four-color image. The black portion of the four-color image is the black plastic surface.

For clear surfaces, such as acrylic basketball backboards, multicolor images are preferably applied to the reverse side of the backboard. In this way, the graphic image receives additional wear protection from the clear backboard. Because the cured UV inks have excellent adhesion to the acrylic backboard surface, as measured by passing the cross-hatch adhesion test described above, it has been found that the printed surface functions as a primer for subsequent assembly of the backboard to a frame structure. Thus, printing on the reverse side of an acrylic basketball backboard can facilitate its assembly to a frame structure.

From the foregoing, it will be appreciated that the present invention provides a process for screen printing multicolor images on basketball backboards using UV inks. The cured UV inks containing a suitable catalyst possess excellent adhesion and weatherability. The ability to use fine mesh screens permits high resolution graphic images to be printed, including photographic and four-color process printing.

The present invention may be embodied in other specific forms without departing from its essential characteristics. The described embodiments are to be considered in all respects only as illustrative and not restrictive. The scope of the invention is, therefore, indicated by the appended claims rather than by the foregoing description.

What is claimed is:

1. A process for screen printing images on basketball backboards comprising:

(a) positioning a basketball backboard having a printing surface in a screen printing assembly;

(b) screen printing an image on the printing surface with an ultraviolet light-cured ink, said ink containing a catalyst to impart adhesion and weatherability to said ink when said ink is cured; and (c) curing the ink with ultraviolet light.

2. A process according to claim 1, further comprising the step of repeating steps (a) through (c) to produce a multicolor image on the basketball backboard.

3. A process according to claim 1, wherein the catalyst has a concentration in the range from about 5% to about 10%, by weight, of the ink.

4. A process according to claim 1, wherein the image is screen printed with a screen having a mesh size in the range from about 355 to 405 mesh.

5. A process according to claim 4, wherein the image is screen printed with a screen having a plain weave.

6. A process according to claim 4, wherein the image is screen printed with a screen having a twill weave.

7. A process according to claim 1, wherein the ink, when cured, passes a standard adhesion scratch test according to ASTM D3359.

8. A process according to claim 1, wherein the ink, when cured, passes simulated weathering conditions in a QUV tester according to ASTM G 53-88 for approximately 1000 hours.

9. A process according to claim 1, wherein the basketball backboard is blow molded polyolefin.

10. A process according to claim 1, wherein the basketball backboard is acrylic.

11. A process according to claim 1, wherein the basketball backboard is a graphite composite.

12. A process according to claim 1, wherein the basketball backboard is dark colored and wherein the process comprises the step of printing a white image corresponding to a reverse black image and thereafter printing one or more color images over the white image.

13. A process for screen printing multicolor images basketball backboards comprising:

(a) positioning a basketball backboard having a printing surface in a screen printing assembly;

(b) screen printing an image on the printing surface with an ultraviolet light-cured ink, said ink containing a catalyst to impart adhesion and weatherability to said ink when said ink is cured, wherein the catalyst has a concentration in the range from about 5 to about 10%, by weight, of the ink, wherein the image is screen printed with a screen having a mesh size in the range from about 355 to 405 mesh;

(c) curing the ink with ultraviolet light; and (d) repeating steps (a) through (c) to produce a multicolor image on the basketball backboard.

14. A process according to claim 13, wherein the ink, when cured, passes a standard adhesion scratch test according to ASTM D3359.

15. A process according to claim 13, wherein the ink, when cured, passes simulated weathering conditions in a QUV tester according to ASTM G 53-88 for approximately 1000 hours.

16. A process according to claim 13, wherein the basketball backboard is blow molded polyolefin.

17. A process according to claim 13, wherein the basketball backboard is acrylic.

18. A process according to claim 13, wherein the basketball backboard is a graphite composite.

19. A process according to claim 13, wherein the basketball backboard is dark colored and wherein the process comprises the step of printing a white image corresponding to a reverse black image and thereafter printing one or more color images over the white image.

20. A process according to claim 13, wherein the image is screen printed with a screen having a plain weave.

21. A process according to claim 13, wherein the image is screen printed with a screen having a twill weave.

* * * * *